US008708170B2

(12) United States Patent
Schneider et al.

(10) Patent No.: US 8,708,170 B2
(45) Date of Patent: Apr. 29, 2014

(54) CRANE CONTROL FOR THE CONTROL OF A HOISTING GEAR OF A CRANE

(75) Inventors: Klaus Schneider, Hergatz (DE); Oliver Sawodny, Stuttgart (DE); Sebastian Kuechler, Boeblingen (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 319 days.

(21) Appl. No.: 12/832,512

(22) Filed: Jul. 8, 2010

(65) Prior Publication Data

US 2011/0006024 A1 Jan. 13, 2011

(30) Foreign Application Priority Data

Jul. 8, 2009 (DE) ..... 10 2009 032 269

(51) Int. Cl.
*B66C 13/06* (2006.01)
*B66C 13/12* (2006.01)

(52) U.S. Cl.
USPC ..... 212/272; 212/284

(58) Field of Classification Search
USPC ..... 212/272, 275, 203, 256, 308, 284
See application file for complete search history.

(56) References Cited

U.S. PATENT DOCUMENTS

| | | | | |
|---|---|---|---|---|
| 5,377,296 | A | 12/1994 | Greenway et al. | |
| 6,039,193 | A * | 3/2000 | Naud et al. | 212/270 |
| 6,460,711 | B1 * | 10/2002 | Kato et al. | 212/275 |
| 2007/0219662 | A1 * | 9/2007 | Sawodny et al. | 700/213 |
| 2009/0211999 | A1 * | 8/2009 | Webster | 212/308 |
| 2013/0213919 | A1 * | 8/2013 | Kyllingstad | 212/272 |

FOREIGN PATENT DOCUMENTS

| | | |
|---|---|---|
| DE | 4130970 | 4/1992 |
| DE | 19612570 | 10/1997 |
| DE | 102006043492 | 3/2008 |
| DE | 102007039408 | 11/2008 |
| EP | 798488 | 10/1997 |
| EP | 1652810 | 5/2006 |
| EP | 1880971 | 1/2008 |
| JP | 2005-320146 | 11/2005 |
| WO | 2008/031477 | 3/2008 |

* cited by examiner

*Primary Examiner* — Emmanuel M Marcelo
*Assistant Examiner* — Justin Stefanon
(74) *Attorney, Agent, or Firm* — Dilworth & Barrese, LLP.

(57) ABSTRACT

The present invention relates to a crane control for the control of a hoisting gear of a crane which takes account of oscillation dynamics based on the elasticity of the hoist rope on the control of the hoisting gear and reduces them by a suitable control of the hoisting gear.

19 Claims, 4 Drawing Sheets

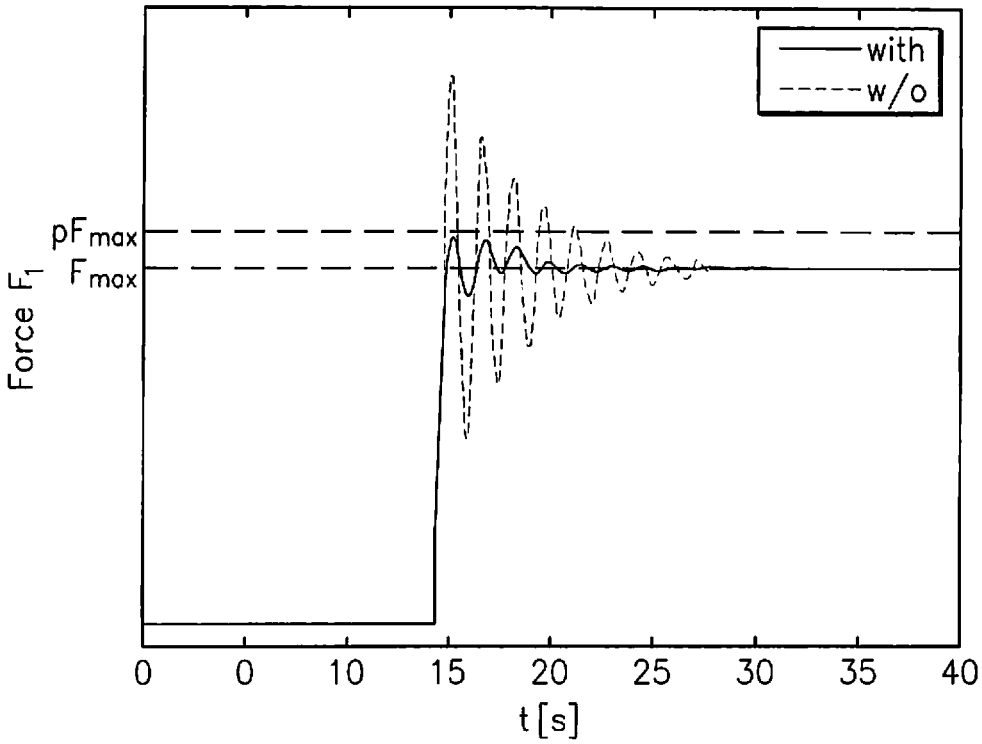
*FIG. 1*
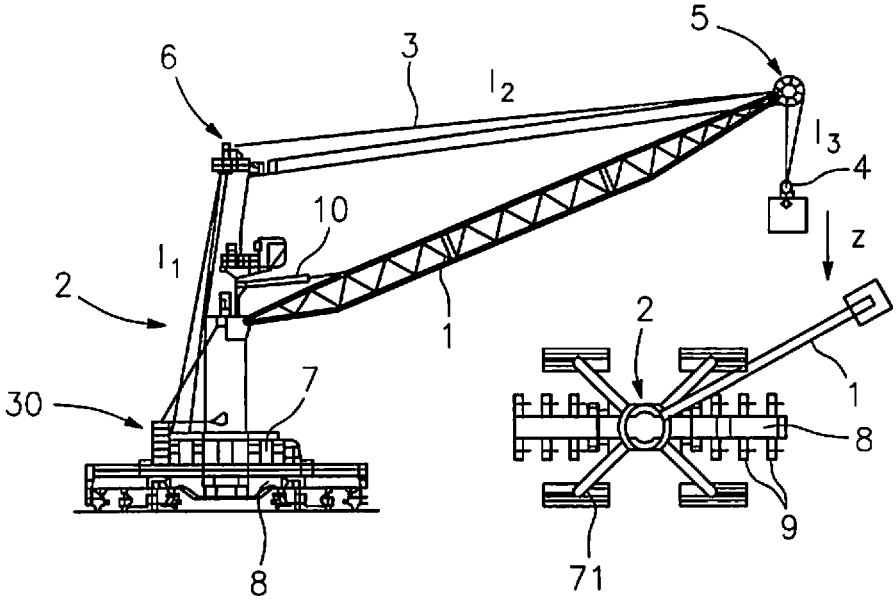
*FIG. 2A* *FIG. 2B*

CRANE CONTROL FOR THE CONTROL OF A HOISTING GEAR OF A CRANE

BACKGROUND OF THE INVENTION

The present invention relates to a crane control for the control of a hoisting gear of a crane. It is in particular in this respect an electronic crane control which determines control signals for the hoisting gear of a crane from the inputs signals input by an operator by means of input elements, in particular by means of hand levers. Alternatively, the input signals can also be generated by an automatization system.

On the raising of the load by the crane, in addition to the static loads which act on the rope and on the crane due to the weight of the load, further dynamic loads arise by the movement of the load. In order also to be able to take up these dynamic loads, the crane structure must be made correspondingly more stable or the static maximum load must be reduced accordingly.

In known crane controls, the operator determines the speed of the hoisting gear freehand by actuation of the hand levers. On a corresponding operation, substantial dynamic loads can therefore arise which have to be taken into account by a correspondingly stable (and so expensive) construction of the crane.

SUMMARY OF THE INVENTION

It is the object of the present invention to provide an improved crane control.

This object is satisfied in accordance with the invention by a crane control in accordance with the description herein. The present invention thus provides a crane control for the control of a hoisting gear of a crane which takes account of the oscillation dynamics based on the elasticity of the hoist rope in the control of the hosting gear and reduces or damps them by a suitable control of the hoisting gear. The oscillation dynamics of the system of rope and load is in this respect in particular taken into account. Further advantageously, the hoisting gear and/or the crane structure can also be taken into account. It is hereby possible to reduce the dynamic loads, which act on the rope and the crane structure, by use of the crane control in accordance with the invention. The crane structure can hereby be built correspondingly lighter or can be operated with higher static loads. The crane control in accordance with the invention can in this respect in particular limit the hosting force acting on the crane structure to a maximum permitted value by taking account of the oscillation dynamics of the system of hoisting gear, rope and load.

The crane control in accordance with the invention advantageously includes an oscillation reduction operation in which the oscillation dynamics based on the elasticity of the hoist rope are taken into account, while possible movements of the support region on which the crane structure is supported are not taken into account in the control of the hoisting gear. The control therefore assumes a stationary support region in oscillation reduction operation. The control in accordance with the invention therefore only has to take oscillations into account which arise due to the hoist rope and/or the hoisting gear and/or the crane structure. Movements of the support region such as e.g. arise with a floating crane due to wave movement, in contrast, remain out of consideration in oscillation reduction operation. The crane control can thus be designed substantially more simply.

The crane control in accordance with the invention can in this respect be used in a crane whose crane structure is actually supported on a fixed-position support region, in particular on the ground, during the hoisting. The crane control in accordance with the invention can, however, also be used with a floating crane, but does not take the movements of the floating body into account in oscillation reduction operation. If the crane control has an operating mode with active heave compensation, the oscillation reduction operation thus takes place accordingly without any simultaneous active heave compensation operation.

Further advantageously, the method in accordance with the invention is used with transportable and/or mobile cranes. The crane in this respect advantageously has support means via which it can be supported at different hoisting locations. Further advantageously, the method is used with harbor cranes, in particular with mobile harbor cranes, with crawler-mounted cranes, with mobile cranes, etc.

The hoisting gear of the crane in accordance with the invention can be hydraulically driven in this respect. Alternatively, a drive is also possible via an electric motor.

The crane control in accordance with the invention in this respect advantageously determines control signals for the hoisting gear of a crane from the input signals input by an operator by means of input elements, in particular by means of hand levers, with the oscillation dynamics of the system of hoisting gear, rope and load which are based on the elasticity of the hoist rope being taken into account in the determination of the control signals to limit the dynamic forces acting on the rope and on the crane structure. Alternatively or additionally, the crane control can have an automatization system which presets a desired hoisting movement.

In this respect, the drive speed of the hoisting gear is advantageously restricted to a maximum permitted drive speed for the restriction of overshoots in at least one operating phase, in particular during the lifting and/or setting down of the load. The maximum permitted drive speed can in this respect also be equal to zero so that the crane control stops the hoisting gear. The crane control, however, advantageously restricts the drive speed to a speed larger than zero so that the lifting movement is not interrupted.

The present invention makes it possible to restrict overshoots of the hoisting force beyond the static load to a specific amount. The overshoots can in this respect advantageously be restricted to a fixed factor of the maximum load dependent on the boom position.

The taking into account of the oscillation dynamics or the restriction of the drive speed in this respect advantageously takes place at least in such operating phases which are particularly relevant to the dynamic loads of the system of hoist winch, hoist rope and load. Provision can in this respect in particular be made that the drive speed is only restricted in specific operating phases, but is released in other operating phases in order not to restrict an operator unnecessarily. Provision can in particular be made in this respect that the drive speed is only restricted during the lifting and/or setting down of the load and is otherwise released.

Provision is furthermore advantageously made that the drive speed of the hoisting gear is determined with reference to the input signals for so long as the drive speed is below the maximum permitted drive speed. Only if the drive speed determined from the input signals of the operator were above the maximum permitted drive speed is the drive speed restricted to this maximum permitted drive speed. As long as the operator therefore does not exceed the maximum permitted drive speed, he can freely control the hoisting gear as with known crane controls.

The crane control in this respect advantageously determines the maximum permitted drive speed of the hoisting gear dynamically with reference to crane data. No fixed maximum permitted drive speed is therefore preset, but this is rather determined in each case at that time with reference to the situation. The maximum permitted drive speed can hereby constantly be matched to the respective hoisting situation. This has the advantage that the drive speed of the hoisting gear does not have to be restricted by an unnecessarily high amount.

In this respect, the radius of the crane is advantageously included in the maximum permitted drive speed. The radius of the crane in turn determines the maximum force the crane structure can take up and thus the maximum permitted dynamic forces. If the crane is a boom which can be luffed about a horizontal luffing axis, the luffing angle of the boom is thus taken into the determination of the maximum permitted drive speed.

In a further advantageous manner, the maximum permitted drive speed of the hoisting gear is determined in dependence on a hoisting force measured at that time. This makes it possible to limit the overshooting of the hoisting force to a specific value of the maximum permitted static hoisting force. The maximum permitted drive speed advantageously falls in this respect as the hoisting force increases. The maximum permitted drive speed is in particular advantageously inversely proportional to the root of the hoisting force measured at that time. The hoisting force can in this respect be measured via a load mass sensor.

In a further advantageous manner, the maximum permitted drive speed of the hoisting gear is determined in dependence on the rope length. In this respect, the rope length has an influence on the stiffness of the hoist rope and thus on the dynamics of the system of hoist winch, rope and load. In this respect, the rope length is advantageously determined via a measurement of the movement of the hoisting gear or via the control data of the hoisting gear.

In a further advantageous manner, specific constants which depend on the structure of the crane and of the rope are taken into the calculation of the maximum permitted drive speed.

In this respect, the maximum permitted drive speed of the hoisting gear is advantageously determined on the basis of a physical model which describes the oscillation dynamics of the system of hoisting gear, rope and load. It is hereby possible to achieve a precise restriction of the maximum permitted drive speed. In addition, the crane control can be adapted more simply to other crane models.

Since the dynamic loads of the crane and of the crane rope differ greatly in the different phases of a lift, it is of advantage if the crane control is controlled with a respective matching control program in the different phases.

The crane control in accordance with the invention therefore advantageously has a situation recognition system with reference to which the crane control determines the control behavior. The crane control in accordance with the invention in particular in this respect has a finite state machine which determines the control behavior of the crane control with reference to the situation recognition system. It is in particular advantageously a finite state machine which recognizes discrete events and carries out respective preset control programs for the hoisting gear in these states.

The situation recognition system advantageously recognizes a lifting state in which the drive speed of the hoisting gear is limited to avoid overshoots. For this purpose, the finite state machine in this respect advantageously has a lifting state in which the drive speed of the hoisting gear is limited to avoid overshoots. The largest dynamic loads on the rope and on the crane arise by the lifting so that it is important that the drive speed of the hoisting gear is limited in accordance with the invention in this phase to avoid overshoots.

In this respect, a change is made into the lifting state when the situation recognition system recognizes that a load lying on the ground is being raised. As long as the load is lying on the ground, the hoist rope is first tensioned by the winding up of the hoist rope until the load raises off the ground. During this phase, the drive speed of the hoisting gear is limited to avoid overshoots of the load after the raising of the load.

The situation recognition system in this respect advantageously recognizes a lifting state in that the change in the measured hoisting force is monitored. In this respect, the derivative of the hoisting force is advantageously taken into the situation recognition. It can in particular be polled in this respect whether the derivative of the lifting force in accordance with time exceeds a preset minimum value. The absolute value of the force can furthermore also be taken into the situation recognition. In this respect, the difference between the hoisting force measured at that time and the last determined static hoisting force which is determined solely by the static weight of the load is advantageously considered. It can in this respect be polled whether this difference exceeds a specific preset value. Since the absolute values of the force are also taken into account, it can be prevented that a lifting state is detected although the load is hanging freely on the hook and there is no threat of too large an overshoot.

In a further advantageous manner, the situation recognition system recognizes a release state in which the drive speed of the hoisting gear is released, with a release state advantageously being recognized when the load was raised and is now hanging freely at the crane rope. The finite state machine advantageously has for this purpose a release state in which the drive speed of the hoisting gear is released. This makes it possible that the operator is not restricted by the crane control in accordance with the invention in those operating phases in which an overshoot of the hoisting force does not have to be expected. In these phases, the hoisting gear can rather be operated freely by the operator without the crane control restricting the drive speed of the hoisting gear.

In this respect, a change into the release state is made when the situation recognition system recognizes that the load has been raised and is now hanging freely at the crane rope. In this situation, no critical dynamics are to be expected so that the operator can now freely operate the hoisting mechanism.

In this respect, data on the movement of the hoisting gear is taken into the situation recognition system to recognize whether the load was raised. The situation recognition system in this respect in particular determines from the measured hoisting force and from data on the stretching behavior of the rope from when the hoisting gear has already wound up sufficient rope to raise the load from the ground.

In a further advantageous manner, the situation recognition system recognizes a setting down state in which the drive speed of the hoisting gear is limited to avoid too much rope being unwound unnecessarily on the setting down of the load. The finite state machine for this purpose advantageously has a setting down state in which the drive speed of the hoisting gear is limited to avoid too much rope being unwound unnecessarily on the setting down of the load. No restrictions are necessary with respect to the stability of the crane structure on the setting down of the load. However, to avoid the crane operator unwinding too much slack rope when he is setting the load on the ground, the crane control in accordance with the invention also engages in such situations.

The previously described embodiments of the crane controls in accordance with the invention substantially engage in the control of the hoisting gear in those phases in which the load is either raised or set down. This is based on the consideration that the largest dynamic effects occur in these phases so that an overshoot can be effectively reduced by a limitation of the speed, in particular by a load-dependent limitation of the speed. While the load is hanging freely on the crane hook, the previously presented control, however, does not engage in a limiting manner, or only engages in a limiting manner in exceptional situations.

The present invention now includes a further control variant which is advantageously used during phases in which the load is hanging freely at the crane rope. In these phases, the crane control is used to avoid natural oscillations of the rope and/or of the crane structure which can likewise be a strain for the ropes and for the crane structure.

In this respect, the present invention includes a crane control for which a desired lifting movement of the load serves as an input variable on the basis of which a control parameter for the control of the hoisting gear is calculated. In this respect, the crane control in accordance with the invention takes account of the oscillation dynamics which arise due to the elasticity of the hoist rope in the calculation of the control parameter. Natural oscillations of the system of rope and load can hereby be damped. A desired lift movement of the load is first generated from the input signals of the operator and/or of an automatization system in this respect which now serves as an input variable of the crane control in accordance with the invention. A control parameter for the control of the hoisting gear to damp natural oscillations is then calculated on the basis of this input variable and while taking account of the oscillation dynamics.

In this respect, in addition to the elasticity of the hoist rope, the oscillation dynamics of the hoisting gear on the basis of the compressibility of the hydraulic fluid are also advantageously taken into account in the calculation of the control parameter. This factor can also cause natural oscillations of the system of hoisting gear, rope and load which exert a strain on the crane structure.

The variable rope length of the hoist rope is advantageously taken into account in the calculation of the control parameter. The rope length of the hoist rope influences the stiffness of the rope and thus its dynamics. In a further advantageous manner, the measured hoisting force or the weight of the load hanging on the load rope determined therefrom is taken into the calculation of the control parameter. The weight of the load hanging at the load rope in this respect substantially influences the dynamics of the system of hoist rope, hoisting gear and load.

The control of the hoisting gear in this respect advantageously takes place on the basis of a physical model which describes the lifting movement of the load in dependence on the control parameter of the hoisting gear. A very good oscillation damping can hereby be achieved. In addition, the use of a physical model allows a fast matching of the crane control in accordance with the invention to other cranes. Such a matching can in this respect in particular take place on the basis of simple calculations and data of the crane. In this respect, the model advantageously assumes a fixed-position support location for the crane.

The control of the hoisting gear in this respect advantageously takes place on the basis of an inversion of the physical model. The control parameter of the hoisting gear is obtained in dependence on the lifting movement of the load which can be used as an input variable of the control by the inversion of the physical model.

It is furthermore conceivable to combine the two variants for a crane control in accordance with the invention. In this respect, a restriction of the speed of the hoisting gear can in particular take place when the finite state machine is in the lifting state and the control of the hoisting gear can take place on the basis of the desired lifting movement when the finite state machine has changed into the release state.

The present invention furthermore includes a method for the control of a hoisting gear of a crane by means of a crane control, with the oscillation dynamics of the system of hoisting gear, rope and load based on the elasticity of the hoist rope being taken into account in the control of the hoisting gear and being reduced or damped by the crane control by a suitable control of the hoisting gear. The control of the hoisting gear in this respect in particular takes place by means of a crane control in accordance with the invention such as was presented above.

The present invention further includes a crane having a crane control such as was presented above.

BRIEF DESCRIPTION OF THE DRAWINGS

The present invention will now be presented in more detail with reference to embodiments and to drawings. There are shown:

FIG. 1 the overshoot in the force measurement axis of the hoisting gear on the raising of a load with and without the use of a crane control in accordance with the present invention;

FIG. 2: a first embodiment of a crane in which a crane control in accordance with the invention is used;

DESCRIPTION OF THE PREFERRED EMBODIMENTS

Figure 3:
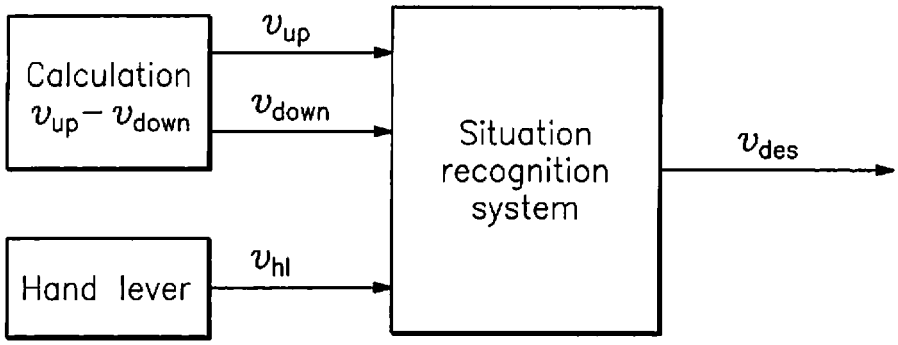
FIG. 3: a schematic diagram of a first embodiment of a crane control in accordance with the invention having a situation recognition system and a restriction of the drive speed of the hoisting gear during a lifting state.

In FIG. 2, an embodiment of the crane in accordance with the invention is shown which is equipped with an embodiment of a crane control in accordance with the invention. In this respect, a crane has a boom 1 which is pivotally connected to the tower 2 in a manner luffable about a horizontal luffing axis. In this respect a hydraulic cylinder 10 which is pivotally connected between the boom 1 and the tower 2 is provided for the luffing up and down of the boom 1 in the luffing plane. The tower 2 is arranged rotatable about a vertical axis of rotation. The tower 2 is for this purpose arranged on a superstructure 7 which can be rotated with respect to an undercarriage 8 via a slewing gear. The embodiment is in this respect a mobile crane for which the undercarriage 8 is equipped with a traveling gear 9. The crane can then be supported via support elements 71 at the hoist position.

The lifting of the load in this respect takes place via a hoist rope 3 at which a load receiving element 4, in this case a crane hook, is arranged. The hoist rope 3 is in this respect guided via pulley blocks at the boom tip 5 as well as at the tower peak 6 to the hoisting gear 30 at the superstructure and the length of the hoist rope can be changed via it. In this respect, the hoisting gear 30 is made as a hoist winch.

In accordance with the invention, the crane control takes account of the dynamics of the system of hoisting gear, hoist rope and load in the control of the hoisting gear to reduce oscillations due to the elasticity of the hoist rope.

A first embodiment of a control method implemented in a crane control in accordance with the invention will be presented in more detail in the following.

1 Introduction on the First Embodiment

In accordance with DIN EN 13001-2 and DIN EN 14985, the steel construction in a revolving boom crane can be reduced provided that a maximum overshoot can be guaranteed in the force measurement axis of the hoisting gear. In this respect, the maximum permitted radius-dependent hoisting force may only be exceeded by the p-fold value by the dynamic overshoot on the raising of a load from the ground. To ensure such a maximum overshoot, an automatic hoisting system can be used.

FIG. 1 shows the measured hoisting force on the raising of a load without an automatic hoisting system and with an automatic hoisting system which ensures a maximum overshoot by the p-fold value. The automatic hoisting system presented in the following guarantees that the maximum permitted radius-dependent maximum force in the hoisting gear on the raising of a load from the ground is never exceeded by more than the p-fold value. In addition, the automatic hoisting system discussed here reduces the hoisting gear speed on the setting down of a load on the ground. It should thus be avoided that the crane operator unwinds too much slack rope when he sets a load down on the ground.

2 Crane Model in the First Embodiment

In the following, the crane model will be described which is used in the first embodiment for the development of the automatic hoisting system. FIG. 2 shows the complete structure of a harbor mobile crane. The load with the mass $m_l$ is raised by the crane by means of the load take-up means and is connected to the hoist winch via the rope having the total length $l_r$. The rope is deflected from the load take-up means via a respective one deflection pulley at the boom head and at the tower. It must be noted in this respect that the rope is not directly deflected to the hoist winch by the boom head, but that is rather deflected by the boom head to the tower, then back to the boom head and then via the tower to the hoist winch (see FIG. 2). The total rope length thus results as $$l_r(t)=l_1(t)+3l_2(t)+l_3(t), \tag{1}$$

where $l_1$, $l_2$ and $l_3$ are the part lengths from the hoist winch to the tower, from the tower to the boom head and from the boom head to the load take-up means. It is now assumed that the crane behaves like a spring mass damper on the lifting of a load. The total spring stiffness of the crane on the lifting of a load is composed of the spring stiffness of the ropes and the spring stiffness of the crane (deflection of the tower, of the boom, etc.). The spring stiffness of a rope results as $$c_r = \frac{E_r A_r}{l_r} \tag{2}$$

where $E_r$ and $A_r$ are the modulus of elasticity and the cross-sectional area of the rope. Since $n_r$ parallel ropes raise the load at the harbor mobile crane (cf. FIG. 2), the spring stiffness $c_{rope}$ of the ropes results as $$c_{rope}=n_r c_r. \tag{3}$$

It is assumed for the calculation of the total spring stiffness that the stiffnesses of the crane and of the ropes are connected in series, i.e.

$$c_{total} = \frac{c_{crane}\, c_{rope}}{c_{crane} + c_{rope}}. \tag{4}$$

3 Automatic Hoisting System in the First Embodiment

The automatic hoisting system presented here is based on a finite state machine with discrete events and which should detect the raising of a load. As soon as a load is raised, the hoisting speed should be reduced to a preset value and a maximum overshoot of the dynamic hoisting force should thus be guaranteed. Once the load has been fully raised from the ground, the hoisting gear speed should again be released by the automatic hoisting system.

In addition, the automatic hoisting system should detect the setting down of the load and should likewise reduce the hoisting gear speed. The hoisting gear should also again be released subsequent to the setting down here.

The scheme of the automatic hoisting system is shown in FIG. 3. Within the block "Presetting $v_{up}$, $v_{down}$", the permitted maximum speeds for a load raising and a load setting down are calculated or preset. The exact calculation is described in the following section. It is detected in the block "Situation recognition" whether a load is being raised from the ground or is being set down on the ground or whether the crane is in the normal operating mode. On the basis of the situation at that time, the corresponding desired speed $v_{des}$ is then selected. This decision is based, as described above, on a finite state machine with discrete events.

It must be noted in the following description that the z axis of the load movement is directed downwardly (see FIG. 2). The load is thereby lowered by a positive hoisting gear speed $v_{hg}$ and is raised by a negative hoisting gear speed $v_{hg}$.

3.1 Presetting $v_{up}$, $v_{down}$

Within this block, the maximum permitted hoisting speed $v_{up}$ on the lifting of the load from the ground is calculated. This speed depends on the hoisting force $F_l$ measured at that time, on the radius-dependent maximum permitted hoist load $m_{max}$ and on the total spring stiffness $c_{total}$. It is assumed for the calculation that the hoisting movement of the load shortly after the raising from the ground is composed of a constant hoisting movement and of a superimposed oscillation. The oscillation is in this respect described by a non-damped spring-mass system. The measured hoisting force thus results as $$F_l=F_{const}+F_{dyn}, \tag{5}$$

where $F_{const}=m_l g$ is the constant load force on the basis of gravity. The dynamic hoisting force $F_{dyn}$ is described by the dynamic spring force of the spring-mass oscillator.

$$F_{dyn}=m_l\ddot{z}_{dyn}, \tag{6}$$

where $\ddot{z}_{dyn}$ is the acceleration of the load (without the acceleration due to gravity). The differential equation for the non-damped spring-mass system is $$m_l\ddot{z}_{dyn}+c_{total}z_{dyn}=0. \tag{7}$$

The initial conditions for (7) result as $$z_{dyn}(0)=0, \tag{8}$$

$$\text{since } F_{dyn}(0)=m_l\ddot{z}_{dyn}(0)=-c_{total}z_{dyn}(0)=0 \text{ and } \dot{z}_{dyn}(0)=-v_{up}, \tag{9}$$

since the load having the speed $v_{up}$ should raise from the ground (z is downwardly positively directed). The general solution of (7) is given by $$z(t)=A\sin(\omega t)+B\cos(\omega t) \tag{10}$$

The coefficients A and B can be calculated by the initial conditions (8) and (9) and result as $$A=-\frac{v_{up}}{\omega}, \tag{11}$$

$$B=0 \tag{12}$$

where $$\omega=\sqrt{\frac{c_{total}}{m_l}}.$$

The time development of the dynamic force thus results as $$F_{dyn}(t)=m_l v_{up}\omega\sin(\omega t) \tag{13}$$

and therefore $$\max(F_{dyn}(t))=m_l v_{up}\sqrt{\frac{c_{total}}{m_l}}, \tag{14}$$

since $-1\leq\sin(\omega t)\leq 1$. The maximum overshoot in the hoisting force should now equal to $pm_{max}g$; it therefore results for the maximum permitted hoisting speed on the raising $$pm_{max}g=m_l v_{up}\sqrt{\frac{c_{total}}{m_l}}, \tag{15}$$

$$v_{up}=\frac{pm_{max}g}{\sqrt{c_{total}m_l}}. \tag{16}$$

The then current hoisting load $m_l$ during the raising (load has not yet been raised) can be calculated by the measured load force. For at this point in time, there is not yet any dynamic force $F_{dyn}$ present. It applies during the so-called tautening of the hoisting gear rope $$F_l=F_{const} \tag{17}$$

and thus $$m_l=\frac{F_l}{g}. \tag{18}$$

In addition, the maximum permitted hoisting gear speed on the setting down of the load $v_{down}$ is preset within this block. This can be selected as a constant value since no restrictions due to standards have to be observed here. The deceleration to this speed should only serve the slack rope security.

3.2 Situation Recognition

Figure 4:
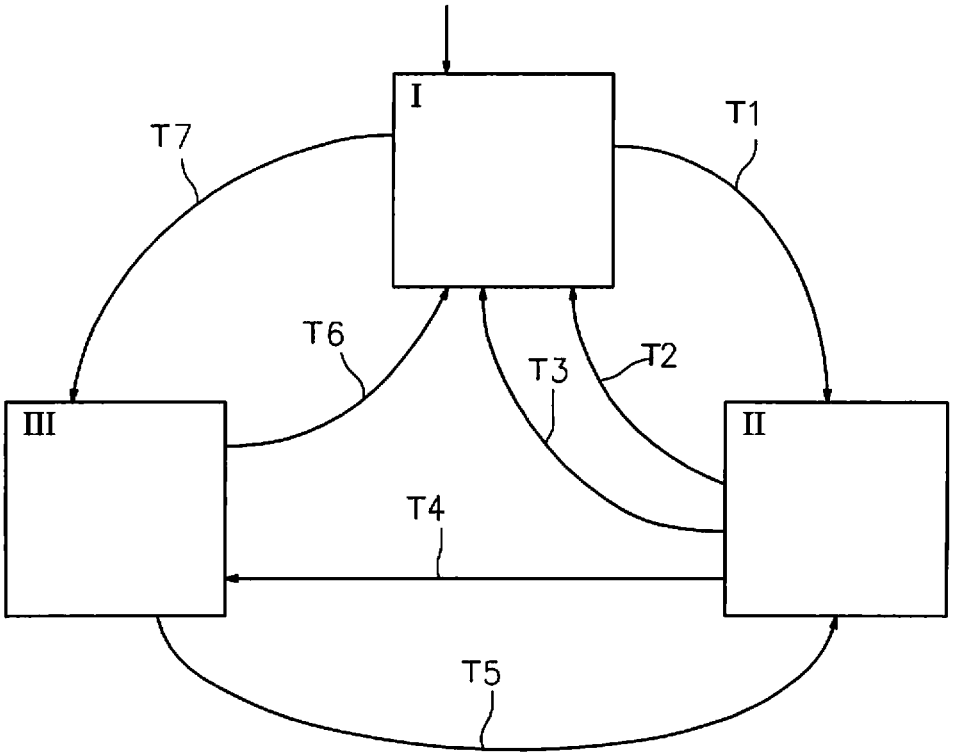
FIG. 4: a schematic diagram of the finite state machine of the first embodiment.

In this block, the corresponding desired speed is selected on the basis of the situation at the time by means of a finite state machine with discrete events. The finite state machine used here is shown in FIG. 4. The associated transitions ("T") and actions in the individual states are described below. The individual variables are collected in Table 1.

3.2.1 General Calculations

The calculations described in this section are carried out independently of the respective state. In the following, the measured load mass $m_l$ is understood as the load mass at the hook measured through the force measurement axis while neglecting the dynamic forces, i.e. $m_l=F_l/g$.

Calculation of $\dot{F}_l$:

This is the time derivation of the hoisting force measured at the time.

Calculation of $\Delta m_{up}$:

This is the absolute difference of the measured load mass in comparison with the measured load mass in the last local minimum of the measured signal which is designated in the following as $m_{0,up}$. In addition, $m_{0,up}$ is updated ($m_{0,up}=m_l$) when the transition 2 is past in the finite state machine. This is the case when it is detected after a load lifting that the load has raised from the ground.

Calculation of $\Delta m_{down}$:

This is the absolute difference of the measured load mass in comparison with the measured load mass in the last local maximum of the measured signal which is designated in the following as $m_{0,down}$. In addition, $m_{0,down}$ is updated ($m_{0,down}=m_l$) when the transition 6 is past in the finite state machine. This is the case when the hoisting gear is released again after a setting down of the load.

Calculation of $\Delta m_{up,det}$:

This is the threshold value which has to be exceeded by $\Delta m_{up}$ so that a detection of the load lifting is possible. This threshold is dependent on the respective crane type and on the measured signal at the last local minimum $m_{0,up}$.

Calculation of $\Delta m_{down,det}$:

This is the threshold value which has to be fallen below by $\Delta m_{down}$ so that a detection of the setting down of the load is possible. This threshold is dependent on the respective crane type and on the measured signal at the last local maximum $m_{0,down}$.

Calculation of $\dot{F}_{tresh}$:

This is the threshold value which has to be exceeded by $\dot{F}_l$ to detect a possible load lifting. This threshold value is dependent on the respective crane type, on the total spring stiffness $c_{total}$, on the permitted overshoot p in the force measurement axis and on the ratio of $$\frac{m_l}{M_{max}}$$

where $m_{max}$ is the radius-dependent maximum permitted hoisting load.

3.2.2 Description of the States

State 1 (Release of Hoisting Gear):

Within this state, the hoisting gear is released and can be operated in a standard manner. The system starts after the initialization (starting of the crane) in this state.

Actions and Calculations on Entry into I:

$$\Delta l=0$$

Actions and Calculation when Remaining in I:

Since the hand lever is released within this state, applies $$v_{des}=v_{hl}.$$

State II (Lifting)

The system is in this state after it has been detected that a load is being raised. When the transition into this state is passed, $l_0$ and $m_0$ are initialized with $l_{rel}$ and $m_l$. $l_{rel}$ is the relative value of the angular transmitter of the hoist winch converted into meters and $m_l$ is the load mass measured at that time.

Actions and Calculations when Remaining in II:

As soon as the system is in this state, the calculation of the rope length wound up relative to $l_0$ and the theoretically required rope length for the raising $\Delta l_{raise}$ takes place in each time step $$\Delta l = l_0 - l_{rel}$$

$$\Delta l_{raise} = \frac{(m_l - m_0 + m_{safety})g}{c_{total}}.$$

In this respect, $m_{safety}$ is a safety factor so that more rope than necessary has to be wound up before this state can be quit.

Two cases have to be distinguished in this state on the calculation of the control signal. The then current hand lever speed $v_{hl}$ and the maximum permitted hoisting gear speed on the lifting $v_{up}$ (16) serve the distinguishing of these cases. It must be noted in this respect that a negative v stands for lifting and a positive v for lowering. The two cases are:

1. ($v_{hl}<v_{up}$)
   In this case, the hand lever speed is outside the permitted range so that $$v_{des}=v_{up}.$$

applies.
2. ($v_{hl}>v_{up}$)
   In this case, the hand lever speed is within the permitted range so that $$v_{des}=v_{hl}.$$

applies.

State III (Setting Down)

The system comes into this state as soon as a setting down of the load is detected. When the transition into this state is passed $l_0$ is initialized with $l_{rel}$.

Actions and Calculations when Remaining in III:

As soon as the system is in this state, the calculation of the rope length unwound relative to $l_0$ takes place in every time step.

$$\Delta l=l_0-l_{rel}.$$

Two cases have to be distinguished in this state on the calculation of the control signal. The then current hand lever speed $v_{hl}$ and the maximum permitted hoisting gear speed on the setting down $v_{down}$ serve the distinguishing of these cases. It must be noted in this respect that a negative v stands for lifting and a positive v for lowering. The two cases are:

1. ($v_{hl}>v_{down}$)
   In this case, the hand lever speed is outside the permitted range so that $$v_{des}=v_{down}.$$

appplies.
2. ($v_{hl}<v_{down}$)
   In this case, the hand lever speed is within the permitted range so that $$v_{des}=v_{hl}.$$

applies.

3.2.3 Description of the Transitions

It must be noted in the following that the then currently measured winch speed $v_{hg}$ is defined as follows:

a negative $v_{hg}$ means that the winch is operating lifting;

a positive $v_{hg}$ means that the winch is operating lowering.

Transition 1:

Becomes active as soon as a load lifting from the ground is detected in the state "Release of hoisting gear". The following event activates this transition:

$$(\dot{F}_l>\dot{F}_{tresh})\&\ \&(\Delta m_{up}>\Delta m_{up,det})\&\ \&(v_{hg}<0).$$

The following calculations are carried out on this passing of this transition:

$$l_0=l_{rel}$$

$$m_0=m_l$$

Transition 2:

Becomes active as soon as the hoist winch operates lowering on the load lifting. And the relatively wound up rope length $\Delta l$ was completely unwound again. The system is thus again in the starting state before the load lifting was detected. The following event activates this transition:

$$(v_{hg}>0)\&\ \&(\Delta l<0).$$

The following calculations are carried out on this passing of this transition:

$$m_0=0$$

Transition 3:

Becomes active as soon as it is detected on the load lifting from the ground that the load has been raised from the ground. The following event activates this transition:

$$\Delta l>\Delta l_{raise}.$$

The following calculations are carried out on this passing of this transition:

$$m_0=0.$$

In addition, on the passing of this transition, $m_{0,up}$ is set for the calculation of $\Delta m_{up}$ to the then currently measured load mass $m_l$ (see 3.2.1)

Transition 4:

Is activated as soon as, in the state "Lifting", a setting down of the load is detected or the measured load falls below a specific empty weight of the load take-up means. The following event activates this transition:

$$(v_{hg}>0)\&\ \&((\Delta m_{down}<\Delta m_{down,det})\|(m_l<m_{empty}))$$

The following calculations are carried out on this passing of this transition:

$$l_0=l_{rel}$$

$$m_0=0$$

Transition 5:

Becomes active as soon as a load lifting from the ground is detected in the state "Release of hoisting gear". The following event activates this transition:

$$(\dot{F}_l>\dot{F}_{tresh})\&\ \&(\Delta m_{up}>\Delta m_{up,det})\&\ \&(v_{hg}<0).$$

The following calculations are carried out on this passing of this transition:

$$l_0=l_{rel}$$

$$m_0=m_l$$

Transition 6:

Becomes active as soon as it is detected in the state "Setting down" that the relative wound up rope length $\Delta l$ is again in the starting state (before transition 7 was passed). The following event activates this transition:

$$\Delta l>0$$

On the passing of this transition, $m_{0,down}$ is set for the calculation of $\Delta m_{down}$ to the then currently measured load mass $m_l$ (see 3.2.1).

Transition 7:

Is activated as soon as, in the state "Release of hoisting gear", a setting down of the load is detected or the measured load falls below a specific empty weight of the load take-up means. The following event activates this transition:

$$(v_{hg}>0)\ \&\ \&((\Delta m_{down}<\Delta m_{down,det})\|(m_l<m_{empty}))$$

The following calculations are carried out on this passing of this transition:

$$l_0=l_{rel}$$

4 Results of the Crane Control in Accordance with the First Embodiment

Figure 5:
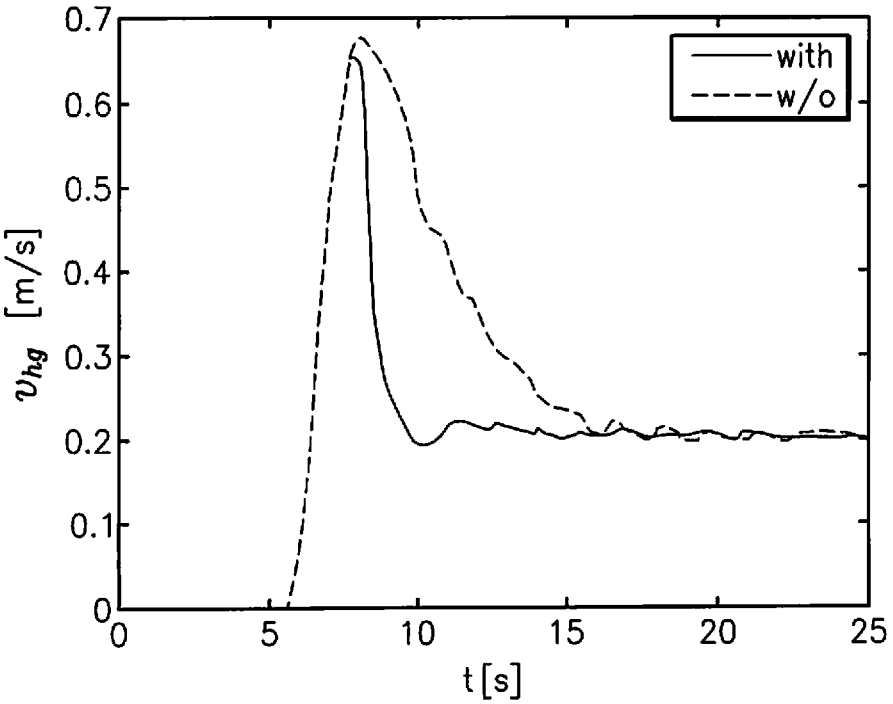
FIG. 5: the drive speed of a hoisting gear on the raising of a load with and without the use of a crane control in accordance with the first embodiment.
Figure 6:
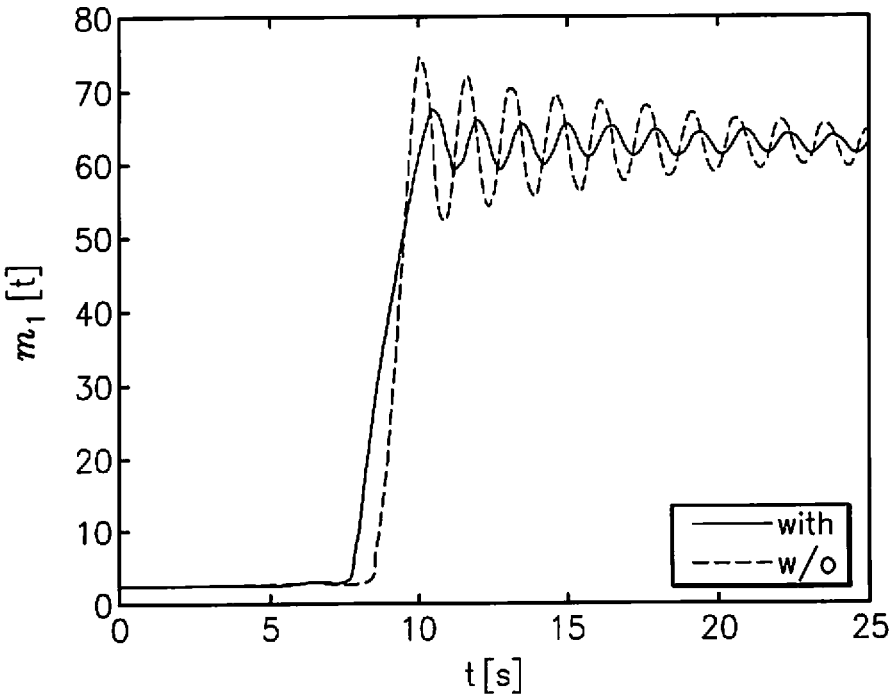
FIG. 6: the lifting force which occurs on the control of the hoisting gear shown in FIG. 5, again with and without the use of a crane control in accordance with the invention in accordance with the first embodiment.

Results of a measurement are shown by way of example in FIGS. 5 and 6 in which the 60t load was lifted from the ground with slack rope. The Figures in each case contain the measurement with and without the automatic hoisting system in accordance with the first embodiment of the present invention.

TABLE 1

Description of the variables from the automatic hoisting system

| Variable name | Description |
|---|---|
| $v_{des}$ | Desired speed which is transmitted to the hoisting gear control. A positive value corresponds to lowering, a negative value corresponds to raising. |
| $v_{up}$ | Calculated permitted absolute speed on lifting. Calculation takes place in accordance with (16). |
| $v_{down}$ | Preset permitted absolute speed on the lowering. |
| $v_{hl}$ | Desired speed preset by the hand lever. |
| $F_l$ | Force in the hoisting gear in N measured through the force measurement axis. |
| $F_{const}$ | Constant force portion in the hoisting gear strand in N. |
| $F_{dyn}$ | Dynamic force portion in the hoisting gear strand in N. |
| $m_l$ | Is the load mass at the hook measured through the force measurement axis while neglecting the dynamic forces. $m_l = F_l/g$. applies. |
| $\dot{F}_l$ | Time derivation of $F_l$ in N/s. |
| $\Delta m_{up}$ | Absolute difference of $m_l$ with respect to the local minimum in the measurement of $m_l$ in kg. |
| $m_{0,up}$ | The last local minimum in the measured signal of $m_l$ in kg. |
| $\Delta m_{down}$ | Absolute difference of $m_l$ with respect to the last local maximum in the measurement of $m_l$ in kg. |
| $m_{0,down}$ | The last local maximum in the measured signal of $m_l$ in kg. |
| $\Delta m_{up,det}$ | Threshold value in kg which has to be fallen below by $\Delta m_{up}$ to detect a possible load lifting. |
| $\Delta m_{down,det}$ | Threshold value in kg which has to be fallen below by $\Delta m_{down}$ to detect a possible load setting down. |
| $m_{max}$ | Radius-dependent permitted maximum load in kg. |
| $F_{max}$ | Radius-dependent permitted maximum force in N. $F_{max} = m_{max}$ g applies. |
| $\dot{F}_{tresh}$ | Threshold which has to be exceeded by $\dot{F}_l$ to detect a load lifting. |
| $\Delta l$ | Relative rope length after the detection of a load lifting or of a load setting down. $\Delta l = l_0 - l_{rel}$. applies. |
| $l_0$ | Starting value for the calculation of the relative rope length $\Delta l$. Becomes active on the passing of the transitions 1, 4, 5, 7. |
| $m_0$ | Measured load mass $m_l$ on the detection of a load lifting in kg. Is required to calculate the theoretical rope length up to the lifting $\Delta l_{ab}$. |
| $m_{safety}$ | Safety factory on the calculation of $\Delta l_{raise}$ in kg. |
| $\Delta l_{raise}$ | Theoretical rope length in m up to the raising of the load after a load lifting has been detected. |
| $v_{hg}$ | Measured hoisting gear speed at the winch in m/s. Positive corresponds to lowering; negative corresponds to raising. |
| $m_{empty}$ | Empty weight of the load take-up means in kg. |
| $l_{rel}$ | Relative rope length in m measured by the relative incremental transducer at the hoist winch. |

5 Introduction on the Second Embodiment

In the following, a second embodiment of a control method implemented in a crane control in accordance with the invention should now be shown in which the dynamics of the system of hoisting gear, hoist rope and load, which is based on the compressibility of the hydraulic fluid and on the elasticity of the load, are taken into account.

Figure 7:
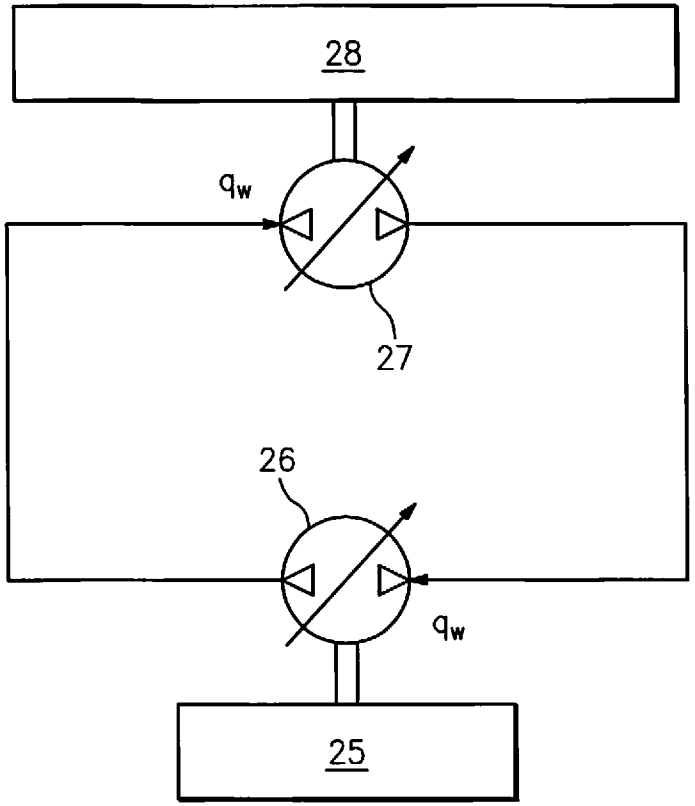
FIG. 7: a schematic diagram of the hydraulic drive of a hoisting gear.

FIG. 7 shows a schematic diagram of the hydraulic system of the hoisting gear. A diesel engine or electric motor 25 is e.g. again provided here which drives a variable delivery pump 26. This variable delivery pump 26 forms a hydraulic circuit with a hydraulic motor 27 and drives it. The hydraulic motor 27 is in this respect also made as a variable capacity motor. Alternatively, a fixed displacement motor could also be used. The hoist winch 28 is then driven via the hydraulic motor 27.

Figure 8:
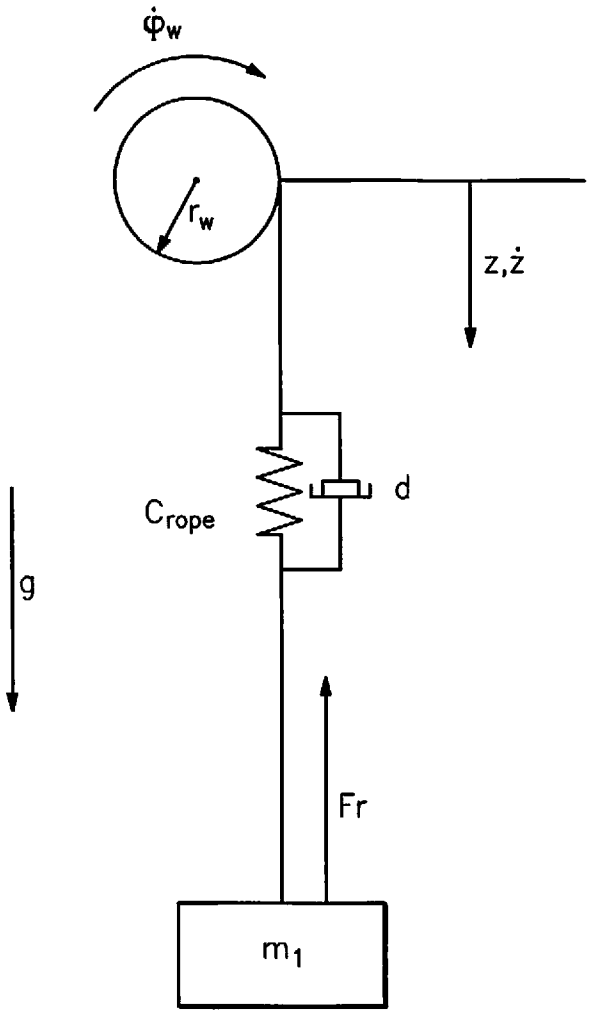
FIG. 8: a schematic diagram of the physical model which is used in a second embodiment for the system of hoisting gear, rope and load.

The physical model by which the dynamics of the system of hoist winch, load rope 3 and the load are described in the second embodiment is shown in FIG. 8. The system comprising the load rope and the load is in this respect considered as a damped spring pendulum system, having a spring constant C and a damping constant D. In this respect, the length of the hoist rope L is taken into the spring constant C and is either determined with reference to measured values or is calculated on the basis of the control of the hoist winch. The mass M of the load which is measured via a load mass sensor is furthermore taken into the control.

The second embodiment is also used for the control of a harbor mobile crane, as is shown in FIG. 2. The boom, the tower and the hoist winch are set into motion via corresponding drives here. The hydraulic drives setting the hoist winch of the crane in motion generate natural oscillations due to the natural dynamics of the hydraulic system and/or of the hoist rope. The resulting force oscillations influence the long-term fatigue of the ropes and of the total crane structure, which results in increased maintenance. In accordance with the invention, a control rule is therefore provided which suppresses the natural oscillations caused by luffing, slewing and hoisting movements of the crane and thereby reduces the load cycles within the Wöhler diagram. A reduction in the load cycles logically increases the service life of the crane structure.

Feedbacks should be avoided on the derivation of the control rule of the second embodiment since they require sensor signals which have to satisfy specific safety demands in industrial applications and thereby lead to higher costs.

The design of a pure feedforward controller without feedback is therefore necessary. A flatness-based feedforward controller which inverts the system dynamics will be derived within this discourse for the hoisting gear.

6 Hoist Winch

The hoist winch of the crane represented in the embodiment is driven by a hydraulically operated rotary motor. The dynamic model and the control rule for the hoist winch will be derived in the following section.

6.1 Dynamic Model

Since the hoisting force is directly influenced by the payload movement, the dynamics of the payload movement must be taken into account. As is shown in FIG. 2, the payload having the mass $m_l$ is attached to a hook and can be raised or lowered by the crane by means of a rope of the length $l_r$. The rope is deflected by a deflection pulley at the boom tip and at the tower. The rope is, however, not deflected directly from the end of the boom to the hoist winch, but rather from the end of the boom to the tower, from there back to the end of the boom and then via the tower to the hoist winch (see FIG. 2). The total rope length is thus given by:

$$l_r = l_1 + 3l_2 + l_3 \tag{38}$$

where $l_1$, $l_2$ and $l_3$ are the part lengths from the hoist winch to the tower, from the tower to the end of the boom and from the end of the boom to the hook. The hoist system of the crane, which comprises the hoist winch, the rope and the payload, is considered in the following as a spring-mass damper system and is shown in FIG. 8. The use of the Newton-Euler method produces the equation of motion for the payload:

$$m_l\ddot{z}_p = m_l g - \underline{(c_{rope}(z_p - r_w\varphi_w) + d(\dot{z}_p - r_w\dot{\varphi}_w))}, \quad z_p(0) = z_{p0},\ \dot{z}_p(0) = 0 \tag{39}$$

with the gravitational constant g, the spring constant $c_{rope}$, the damping constant d, the radius of the hoist winch $r_w$, the angle $\phi_w$ of the hoist winch, the angle speed $\dot{\phi}_w$, the payload position $z_p$, the payload speed $\dot{z}_p$ and the payload acceleration $\ddot{z}_p$. The rope length $l_r$ is given by $$l_r(t) = r_w\phi_w(t) \tag{40}$$

where $$\varphi_w(0) = \varphi_{w0} = \frac{l_1(0) + 3l_2(0) + l_3(0)}{r_w} \tag{41}$$

The spring constant $c_r$ of a rope of the length $l_r$ is given by Hooke's Law and can be written as $$C_r = \frac{E_r A_r}{l_r} \tag{42}$$

where $E_r$ and $A_r$ are the modulus of elasticity and the sectional surface of the rope respectively. The crane has $n_r$ parallel ropes (see FIG. 2) so that the spring constant of the hoisting gear of the crane is given by:

$$c_{rope} = n_r c_r \tag{43}$$

The damping constant d can be given with the help of the dimensionless damping ratio D $$d = 2D\sqrt{cm_1} \tag{44}$$

The differential equation for the rotational motion of the hoist winch results in accordance with the Newton-Euler method as $$(J_w + i_w^2 J_m)\ddot{\phi}_w = i_w D_m \Delta p_w + r_w F_r, \phi_w(0) = \phi_{w0}, \dot{\phi}_w(0) = 0 \tag{45}$$

where $J_w$ and $J_m$ are the moment of inertia of the winch or of the motor respectively, $i_w$ is the gear ratio between the motor and the winch, $\Delta p_w$ is the pressure difference between the high-pressure chamber and the lower-pressure chamber of the motor respectively, $D_m$ is the displacement of the hydraulic motor and $F_r$ is the spring force given in (39). The initial condition $\phi_{w0}$ for the angle of the hoist winch is given by (41). The hydraulic circuit for the hoist winch is shown in FIG. 7. The pressure difference $\Delta p_w$ between the two pressure chambers of the motor is described by the pressure build-up equation under the assumption that there are no internal or external leaks. In addition, the small volume change due to the motor angle $\phi_w$ is neglected in the following. The volume in the two pressure chambers is thus assumed as a constant and is designated by $V_m$. With the help of these assumptions, the pressure build-up equation can be described as $$\Delta\dot{p}_w = \frac{4}{V_m\beta}(q_w - D_m i_w \dot{\varphi}_w), \quad \Delta p_w(0) = \Delta p_{w0} \tag{46}$$

where β is the compressibility of the oil. The oil throughput $q_w$ is preset by the pump angle and is given by $$q_w = K_w u_w \tag{47}$$

where $u_w$ and $K_w$ are the control current of the pump angle and the proportionality factor respectively.

6.2 Control Law

The dynamic model for the hoist winch is transformed into the state space in the following to design a flatness-based feedforward controller. The derivation of the control rule neglects the damping, D=0 therefore applies. The state vector of the hoisting gear of the crane is defined as $x = [\phi_w, \dot{\phi}_w, z_p, \dot{z}_p, \Delta p_w]^T$. The dynamic model comprising (39), (40), (43), (45)

and (47) can thus be written as a system of first order differential equations, the system being given by:

$$\dot{x}=f(x)+g(x)u, y=h(x), x(0)=x_0, t\geq 0 \tag{48}$$

where $$f(x)=\begin{bmatrix} x_2 \\ \frac{1}{J_w+i_w^2 J_m}\left(i_w D_m x_5 + r_w\left(\frac{E_r A_r n_r}{r_w x_1}(x_3 - r_w x_1)\right)\right) \\ x_4 \\ g-\frac{E_r A_r n_r}{r_w x_1 m_l}(x_3 - r_w x_1) \\ \frac{-4D_m i_w x_2}{V_m \beta} \end{bmatrix} \tag{49}$$

$$g(x)=\begin{bmatrix} 0 \\ 0 \\ 0 \\ 0 \\ \frac{4K_w}{V_m \beta} \end{bmatrix} \tag{50}$$

$$h(x)=x_3 \tag{51}$$

and $u=u_w$.

The relative degree r with respect to the system output must be equal to the order n of the system for the design of a flatness-based feedforward controller. The relative degree of the observed system (48) will therefore be examined in the following. The relative degree with respect to the system output is fixed by the following conditions;

$$L_g L_f^i h(x)=0 \forall i=0, \ldots, r-2$$

$$L_g L_f^{r-1} h(x)\neq 0 \forall x\in R^n \tag{52}$$

The operators $L_f$ and $L_g$ represent the Lie derivatives along the vector fields f and g respectively. The use of (52) produces r=n=5 so that the system (48) with (49), (50) and (51) is flat and a flatness-based feedforward controller can be designed for D=0.

The system output (51) and its derivatives are used to invert the system dynamics. The derivatives are given by the Lie derivatives, that is $$y=h(x) \tag{53}$$

$$\dot{y}=\frac{\partial h(x)}{\partial x}\frac{\partial x}{\partial t}=L_f h(x)+\underbrace{L_g h(x)u}_{=0} \tag{54}$$

$$\ddot{y}=\frac{\partial L_f h(x)}{\partial x}\frac{\partial x}{\partial t}=L_f^2 h(x)+\underbrace{L_g L_f h(x)u}_{=0} \tag{55}$$

$$\dddot{y}=\frac{\partial L_f^2 h(x)}{\partial x}\frac{\partial x}{\partial t}=L_f^3 h(x)+\underbrace{L_g L_f^2 h(x)u}_{=0} \tag{56}$$

$$\overset{(4)}{y}=\frac{\partial L_f^3 h(x)}{\partial x}\frac{\partial x}{\partial t}=L_f^4 h(x)+\underbrace{L_g L_f^3 h(x)u}_{=0} \tag{57}$$

$$\overset{(5)}{y}=\frac{\partial L_f^4 h(x)}{\partial x}\frac{\partial x}{\partial t}=L_f^5 h(x)+L_g L_f^4 h(x)u \tag{58}$$

The states in dependence on the system output and its derivatives follow from (53), (54), (55), (56) and (57) and can be written as:

$$x_1=\frac{A_r E_r n_r y}{r_w(g m_l + A_r E_r n_r - m_l \ddot{y})} \tag{59}$$

$$x_2=x_2(y,\dot{y},\ddot{y},\dddot{y}) \tag{60}$$

$$x_3=y \tag{61}$$

$$x_4=\ddot{y} \tag{62}$$

$$x_5=x_5\left(y, \dot{y}, \ddot{y}, \dddot{y}, \overset{(4)}{y}\right) \tag{63}$$

The resolving of (58) after the system input u produces, when using (59), (60), (61), (62) and (63), the control rule for the flatness-based feedforward controller for the hoisting gear $$u_w=f\left(y, \dot{y}, \ddot{y}, \dddot{y}, \overset{(4)}{y}, \overset{(5)}{y}\right) \tag{64}$$

which inverts the system dynamics. The reference signal y and its derivatives are obtained by a numerical trajectory generation from the hand lever signal of the crane operator.

The invention claimed is:

1. A crane having an electronic crane control system for determining control signals for the control of a hoisting gear of the crane, said electronic crane control system comprising a situation recognition system for executing non-transitory computer programs to generate the control signals to control oscillation dynamics based on the elasticity of the hoist rope calculated as a function of the length of the hoist rope, the control signals used to reduce the oscillation dynamics during the control of the hoisting gear.

2. A crane in accordance with claim 1, wherein a drive speed of the hoisting gear is restricted for the restriction of overshoots to a maximum permitted drive speed.

3. A crane in accordance with claim 2, wherein the maximum permitted drive speed of the hoisting gear is dynamically determined based on physical characteristics of the crane.

4. A crane in accordance with claim 3, wherein the maximum permitted drive speed of the hoisting gear is determined in dependence on a then currently measured hoisting force and/or is determined in dependence on a length of the hoist rope.

5. A crane control in accordance with claim 4, wherein the maximum permitted drive speed of the hoisting gear is determined on the basis of a physical model which describes the oscillation dynamics of the hoisting gear, the hoist rope and a load.

6. A crane control in accordance with claim 5, having a situation recognition system with reference to which the crane control determines a control behavior.

7. A crane in accordance with claim 3, wherein the maximum permitted drive speed of the hoisting gear is determined on the basis of a physical model which describes the oscillation dynamics of the hoisting gear, the hoist rope and a load.

8. A crane in accordance with claim 2, wherein the maximum permitted drive speed of the hoisting gear is determined in dependence on a then currently measured hoisting force and/or is determined in dependence on a length of the hoist rope.

9. A crane in accordance with claim 8, wherein the maximum permitted drive speed of the hoisting gear is determined on the basis of a physical model which describes the oscillation dynamics of the hoisting gear, the hoist rope and a load.

10. A crane in accordance with claim 2, wherein the maximum permitted drive speed of the hoisting gear is determined on the basis of a physical model which describes the oscillation dynamics of a combination of the hoisting gear, the hoist rope and a load.

11. A crane in accordance with claim 1, having a situation recognition system with reference to which the crane control determines the control behavior.

12. A crane in accordance with claim 11, wherein the situation recognition system recognizes a lifting state in which the drive speed of the hoisting gear is restricted to avoid overshoots, with the situation recognition system advantageously recognizing a lifting state when a load lying on the ground is raised.

13. A crane in accordance with claim 11, wherein the situation recognition system recognizes a release state in which the drive speed of the hoisting gear is released with a release state advantageously being recognized when the load was raised and is now hanging freely at the crane rope.

14. A crane in accordance with claim 11, wherein the situation recognition system recognizes a setting down state in which the drive speed of the hoisting gear is restricted to prevent too much rope unnecessarily being unwound on the setting down of the load.

15. A crane in accordance with claim 1, wherein a desired hoisting movement of a load serves as an input variable on the basis of which a control parameter is calculated for the control of the hoisting gear, wherein the oscillation dynamics due to the elasticity of the hoist rope are taken into account in the calculation of the control parameter to reduce natural oscillations.

16. A crane control in accordance with claim 15, wherein the hoisting gear is driven hydraulically and the oscillation dynamics due to a compressibility of hydraulic fluid are taken into account in the calculation of the control parameter.

17. A crane in accordance with claim 15, wherein a variable rope length of the hoist rope and/or a measured hoisting force is taken into the calculation of the control parameter.

18. A crane in accordance with claim 15, wherein the control of the hoisting gear is based on a physical model of the crane which describes the hoisting movement of the load in dependence on the control parameter of the hoisting gear, wherein the control of the hoisting gear is based on an inversion of the physical model.

19. A method for the control of a hoisting gear of a crane by an electronic crane control system for determining control signals in accordance with claim 1, said electronic crane control system comprising the situation recognition system for executing the non-transitory computer programs to generate the control signals to control the oscillation dynamics based on the elasticity of the hoist rope in the control of the hoisting gear to generate the control signals to reduce the oscillation dynamics to control the hoisting gear.

* * * * *